US006538573B2

(12) United States Patent
Mizuno

(10) Patent No.: US 6,538,573 B2
(45) Date of Patent: Mar. 25, 2003

(54) EYEGLASS LENS PROCESSING APPARATUS

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 10/026,780

(22) Filed: Dec. 27, 2001

(65) Prior Publication Data

US 2002/0106973 A1 Aug. 8, 2002

(30) Foreign Application Priority Data

Dec. 27, 2000 (JP) ..... 2000-401369

(51) Int. Cl.[7] ..... G08B 21/00
(52) U.S. Cl. ..... 340/618; 451/5; 451/449
(58) Field of Search ..... 340/618, 616, 340/623, 607, 606; 451/5, 449, 9, 7, 255, 256, 450, 285, 286; 137/312

(56) References Cited

U.S. PATENT DOCUMENTS 4,657,068 A * 4/1987 Peltz ..... 165/47
5,570,714 A * 11/1996 Magish ..... 137/202
6,071,047 A * 6/2000 Nakai ..... 451/449
6,074,276 A 6/2000 Shibata et al.

FOREIGN PATENT DOCUMENTS

| | | |
|---|---|---|
| EP | 1 043 121 A1 | 10/2000 |
| JP | 11-320407 | 11/1999 |
| JP | 2001-79315 | 3/2001 |

* cited by examiner

*Primary Examiner*—Anh La
(74) *Attorney, Agent, or Firm*—Sughrue Mion, PLLC

(57) ABSTRACT

An eyeglass lens processing apparatus for processing a periphery of an eyeglass lens, includes: a processing chamber in which a lens processing tool is disposed, the processing chamber having a drainage port; a water supply unit which supplies water for lens processing to an interior of the processing chamber; a drainpipe connected to the drainage port; a sensor which detects an amount of the water within the processing chamber or the drainpipe; and a controller which controls the water supply unit based on a result of detection by the sensor.

9 Claims, 4 Drawing Sheets

EYEGLASS LENS PROCESSING APPARATUS

BACKGROUND OF THE INVENTION

The present invention relates to an eyeglass lens processing apparatus for processing a periphery of an eyeglass lens.

In an apparatus for processing a periphery of an eyeglass lens, a rotating grindstone (a processing tool) is caused to press against the periphery of the lens held on a lens rotating shaft in contact therewith, thereby carrying out the processing. During the processing, water for the processing is supplied in order to cool a portion of the lens to be processed and to remove processing wastes. For this reason, the grindstone is provided on the inside. Therefore, a processing chamber is protected by a waterproof cover for the processing. The used water is discharged through a drainage such as a drainpipe from a drainage port provided in a lower part of the processing chamber.

However, the conventional apparatus suffers from the following problem. More specifically, when the drainage such as a drainage port or a drainpipe is clogged with processing wastes, the water is not discharged but the processing chamber overflows with the water. Consequently, the apparatus breaks down. In order to eliminate such a drawback, a cleaning work for removing the processing wastes is to be carried out at any time and management therefor cannot be performed easily.

SUMMARY OF THE INVENTION

In consideration of the drawbacks of the conventional apparatus, it is a technological object of the invention to provide an eyeglass lens processing apparatus capable of preventing a water overflow due to the clogging of the drainage, and furthermore, of easily managing a cleaning work for removing processing wastes.

In order to attain the object, the invention has the following structure.

(1) An eyeglass lens processing apparatus for processing a periphery of an eyeglass lens, comprising:
- a processing chamber in which a lens processing tool is disposed;
- water supply means for supplying water for lens processing to an interior of the processing chamber;
- water drainage means for discharging the water from the processing chamber;
- detect means for detecting a clogging state of the water drainage means; and
- water supply control means for controlling supply of the water by the water supply means based on a result of detection by the detect means.

(2) The apparatus according to (1), further comprising:
- notifying means for notifying the result of detection by the detection means.

(3) The apparatus according to (1), wherein the detect means detects an amount of the water within the processing chamber.

(4) The apparatus according to (1), wherein:
- the water drainage means includes a drainage port provided to the processing chamber and a drainpipe connected to the drainage port; and
- the detect means detects an amount of the water within the drainpipe.

(5) The apparatus according to (1), further comprising:
- process control means for controlling the lens processing by the lens processing tool based on the result of detection by the detect means.

(6) An eyeglass lens processing apparatus for processing a periphery of an eyeglass lens, comprising:
- a processing chamber in which a lens processing tool is disposed, the processing chamber having a drainage port;
- a water supply unit which supplies water for lens processing to an interior of the processing chamber;
- a drainpipe connected to the drainage port;
- a sensor which detects an amount of the water within the processing chamber or the drainpipe; and
- a controller which controls the water supply unit based on a result of detection by the sensor.

(7) The apparatus according to (6), further comprising:
- a notify unit which notifies the result of detection by the sensor.

(8) The apparatus according to (6), wherein the controller controls the lens processing by the lens processing tool based on the result of detection by the sensor.

(9) An eyeglass lens processing apparatus for processing a periphery of an eyeglass lens, comprising:
- a processing chamber in which a lens processing tool is disposed;
- water supply means for supplying water for lens processing to an interior of the processing chamber;
- water drainage means for discharging the water from the processing chamber;
- detect means for detecting a clogging state of the water drainage means; and
- notifying means for notifying the result of detection by the detection means.

The present disclosure relates to the subject matter contained in Japanese patent application No. 2000-401369 (filed on Dec. 27, 2000), which is expressly incorporated herein by reference in its entirety.

DESCRIPTION OF THE PREFERRED EMBODIMENT

Figure 1:
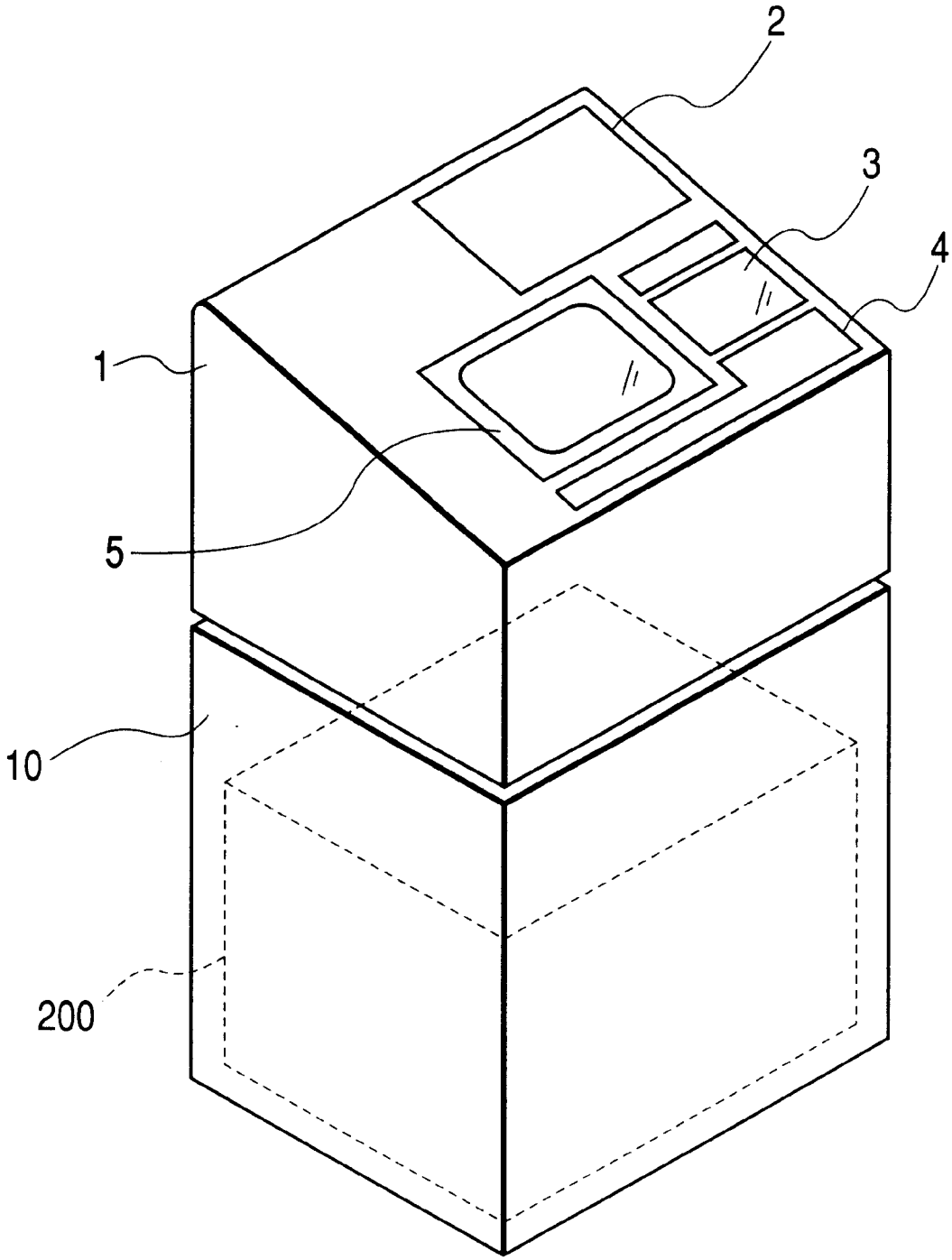
FIG. 1 is a perspective view showing a whole lens processing apparatus.

An embodiment of the invention will be described below with reference to the drawings. FIG. 1 is a perspective view showing a whole lens processing apparatus according to the invention. The processing apparatus is mainly constituted by a body 1, a table 10 for mounting the body 1 thereon, and a tank section 200 for water storage which is provided in the table 10.

An eyeglass-frame-shape measuring section 2 is provided in the upper and right inner portion of the body 1. A display 3 for displaying processing information and a panel 4 having a large number of switches for an operation are provided in front of the measuring section 2. The reference numeral 5 denotes an openable window for a processing chamber 161 (see FIG. 3) provided in the body 1.

Figure 2:
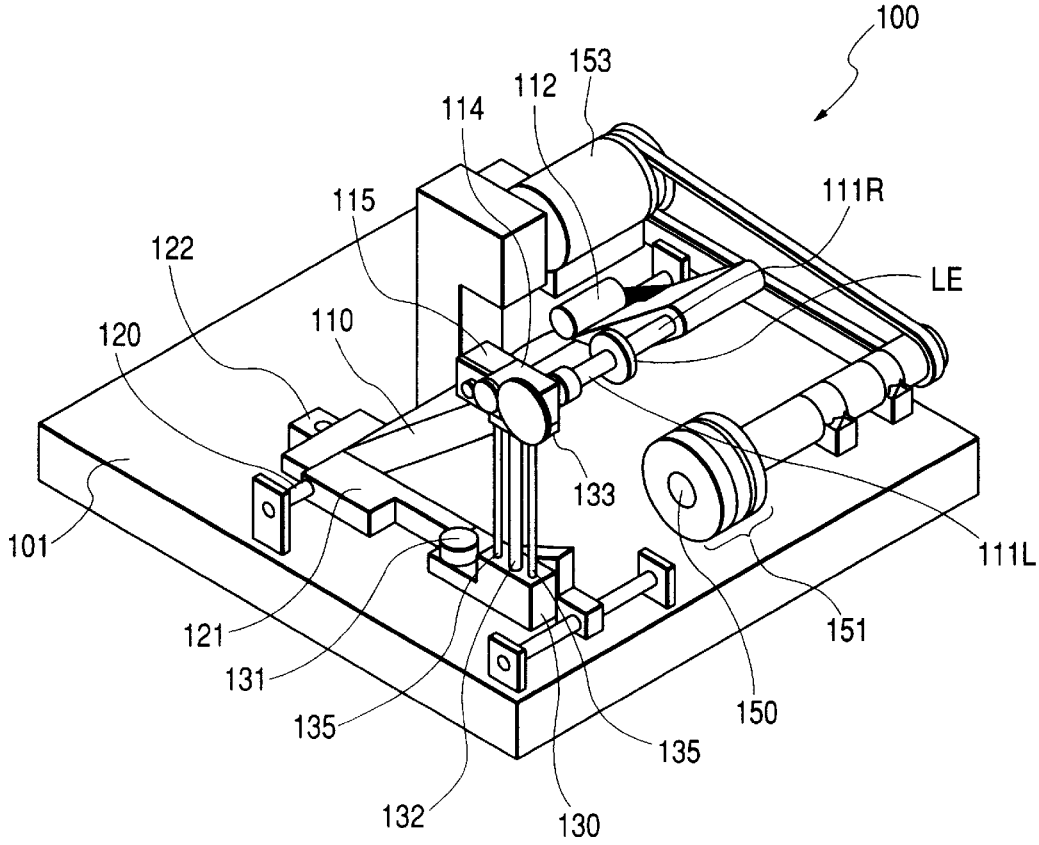
FIG. 2 is a view showing a schematic structure of a processing section.

The schematic structure of a processing section 100 provided in the body 1 will be described with reference to FIG. 2. The reference numeral 101 denotes a base on which the processing section 100 is to be mounted. A lens LE to be processed is held by two lens rotating shafts 111R and 111L of a carriage 110 and is ground by means of a grindstone 151 attached to a grindstone rotating shaft 150. The grindstone 151 is constituted by three grindstones, that is, a rough abrasive wheel for plastic lenses, a rough abrasive wheel for glass lenses and a finishing abrasive wheel having a groove for beveling processing and a flat surface for flat processing. The shaft 150 is rotated by a motor 153 so that the grindstone 151 is rotated.

A block 114 for attaching a motor which is rotatable about an axis of the shaft 111L is fixed to the left arm side of the carriage 110. A motor 115 for lens rotation is fixed to the block 114 and the rotation of the motor 115 is transmitted to the shaft 111L through a gear. A right arm of the carriage 110 is provided with a motor 112 for a chuck which serves to move the shaft 111R in an axial direction thereof.

Moreover, the carriage 110 is rotatably slidable with respect to a carriage shaft 120 in parallel with the shafts 111R and 111L and is moved in a transverse direction together with a moving arm 121 by means of a motor 122.

A swingable block 130 is rotatably attached to the arm 121 about an axis which is in alignment with the center of the shaft 150. A motor 131 for carriage elevation and a feed screw 132 are attached to the block 130, and the rotation of the motor 131 is transmitted to the screw 132 through a belt. A guide block 133 which abuts against a lower end surface of the block 114 is fixed to an upper end of the screw 132, and the guide block 133 moves along two guide shafts 135 implanted on the block 130. When the motor 131 is rotated, the vertical position of the guide block 133 can be changed and the carriage 110 can be vertically moved by setting the carriage shaft 120 to be a center of rotation through the movement of the guide block 133. A spring which is not shown is stretched between the carriage 110 and the arm 121 and the carriage 110 is constantly urged downward so that the lens LE is pushed against the grindstone 151.

Figure 3:
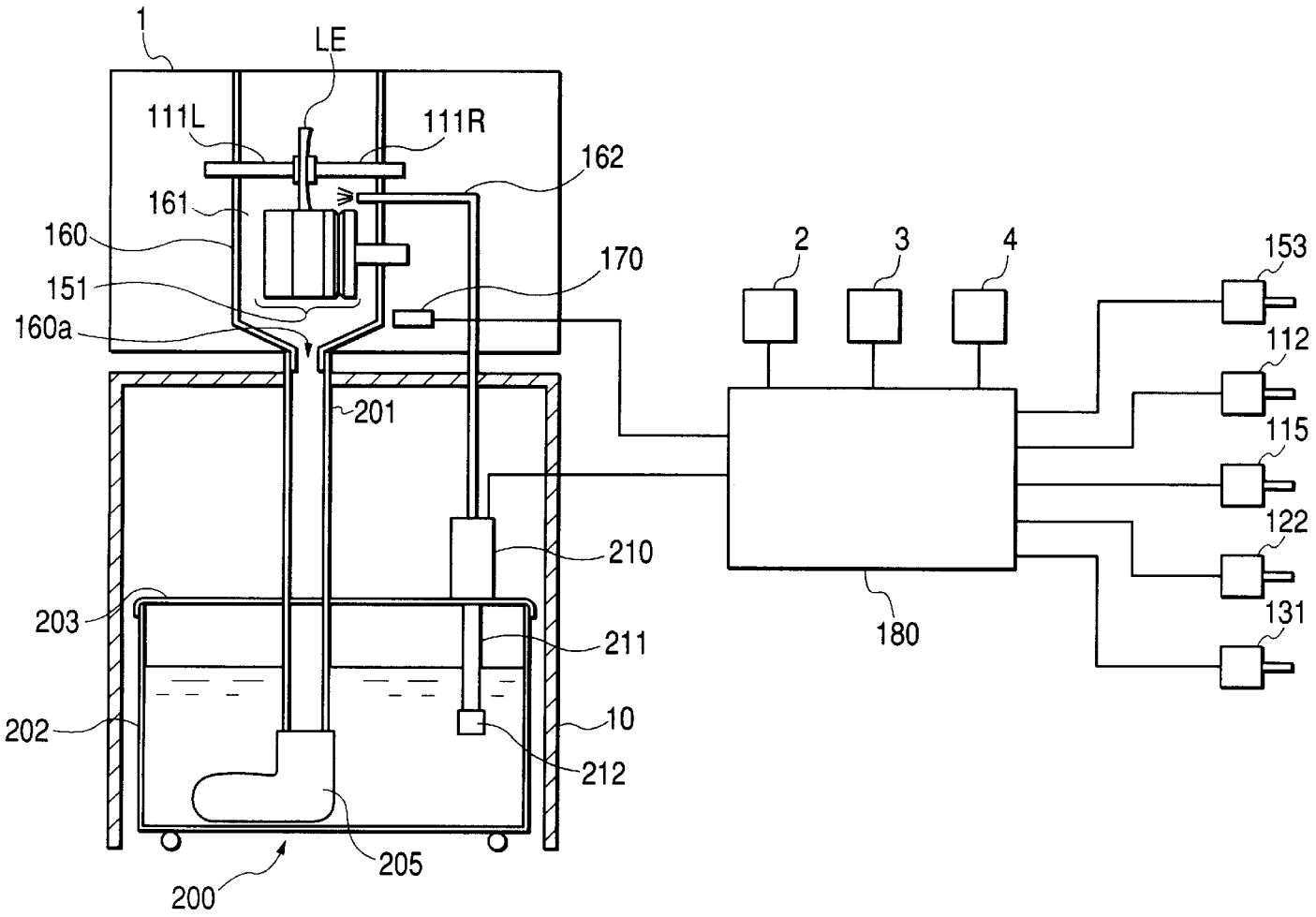
FIG. 3 is a view showing a schematic structure of the whole lens processing apparatus.

FIG. 3 is a view showing the schematic structure of a whole processing apparatus. A processing chamber 161 is formed by a waterproof cover 160 formed of resin in such a configuration that the lens LE held by the shafts 111R and 111L and the grindstone 151 are surrounded. The processing chamber 161 is separated from a mechanism section such as a motor through the cover 160. A nozzle 162 for jetting water for processing is extended into the processing chamber 161 and is connected to a circulating pump 210 of the tank section 200. During the processing of the lens LE, the water is jetted from the nozzle 162 and the jetted water and processing wastes are received by the cover 160.

An electrostatic capacity type sensor 170 for detecting that the water is accumulated in the processing chamber 161 is provided in the vicinity of the lower external wall of the cover 160. The sensor 170 detects an object by utilizing the fact that a conductive object approaches an electrode surface thereof to increase an electrostatic capacity between the electrode surface and the object. More specifically, the sensor 170 detects, through the cover 160, that the conductive water is accumulated in the processing chamber 161. Preferably, the water jetted from the nozzle 162 splashes on the cover 160 portion provided with the sensor 170 as less as possible.

A drainpipe (a drainage hose) 201 is connected to a drainage port 160*a* provided in a lower part of the cover 160 (the processing chamber 161), and the drainpipe 201 is extended into a tank 202 for water storage on the tank section 200 side. The pump 210 is attached to a lid 203 of the tank 202 and a water sucking pipe 211 of the pump 210 is extended into the tank 202. The reference numeral 212 denotes a filter attached to the tip of the water sucking pipe 211. The water taken through the water sucking pipe 211 by driving the pump 210 is supplied to the nozzle 162 on the body 1 side. Moreover, a removable filter 205 which is also used as a bag for collecting the processing wastes is attached to the tip of the drainpipe 201 extended into the tank 202.

The reference numeral 180 denotes a control section of the body 1. The sensor 170, the pump 210, the measuring section 2, the display 3, the panel 4 and each motor of the processing section 100 are connected to the control section 180.

In the processing, necessary data such as a frame shape measured by the measuring section 2 or layout data are input to chuck the lens LE into the rotating shafts 111R and 111L. When a processing start switch of the panel 4 is pushed to start the processing, the lens LE is pressed against the grindstone 151 in contact therewith by the movement of the carriage 110 and a peripheral edge thereof is processed based on the input data. During the processing, the pump 210 is driven and the water stored in the tank 202 is supplied from the nozzle 162 to the processing portion of the lens LE. The processing wastes generated during the processing and the water are received by the cover 160, and the water is discharged to the tank section 200 side through the drainage port 160*a* and the drainpipe 201. The water is filtered by means of the filter 205 and is supplied to the body 1 side again.

By repeating such processing, the processing wastes are accumulated in the filter 205. When the filter 205 is clogged, the water is discharged from the drainpipe 201 with difficulty. For this reason, a water level in the drainpipe 201 is raised so that the water is also accumulated in the processing chamber 161. When the level of the water accumulated in the processing chamber 161 reaches a height of arrangement of the sensor 170 (the water level becomes higher than the height of arrangement of the sensor 170), the sensor 170 detects that the water is accumulated. More specifically, when the water is accumulated in the processing chamber 161, a conductive object becomes present so that an output signal of the sensor 170 is changed. The output signal of the sensor 170 is input to the control section 180 and the control section 180 detects, based on a change in the signal, that the water is accumulated.

The control section 180 immediately stops the driving operation of the pump 210 to halt the water supply based on the result of the detection, and drives the motor 131 for vertically moving the carriage 110, thereby temporarily stopping the processing operation. At the same time, the display 3 is caused to display a message indicating that the processing wastes are to be cleaned. Consequently, a worker knows that cleaning and inspection are required. Therefore, the worker removes the cause of the clogging. After the cause of the clogging is removed, the processing start switch of the panel 4 is pushed to restart the processing.

Figure 4:
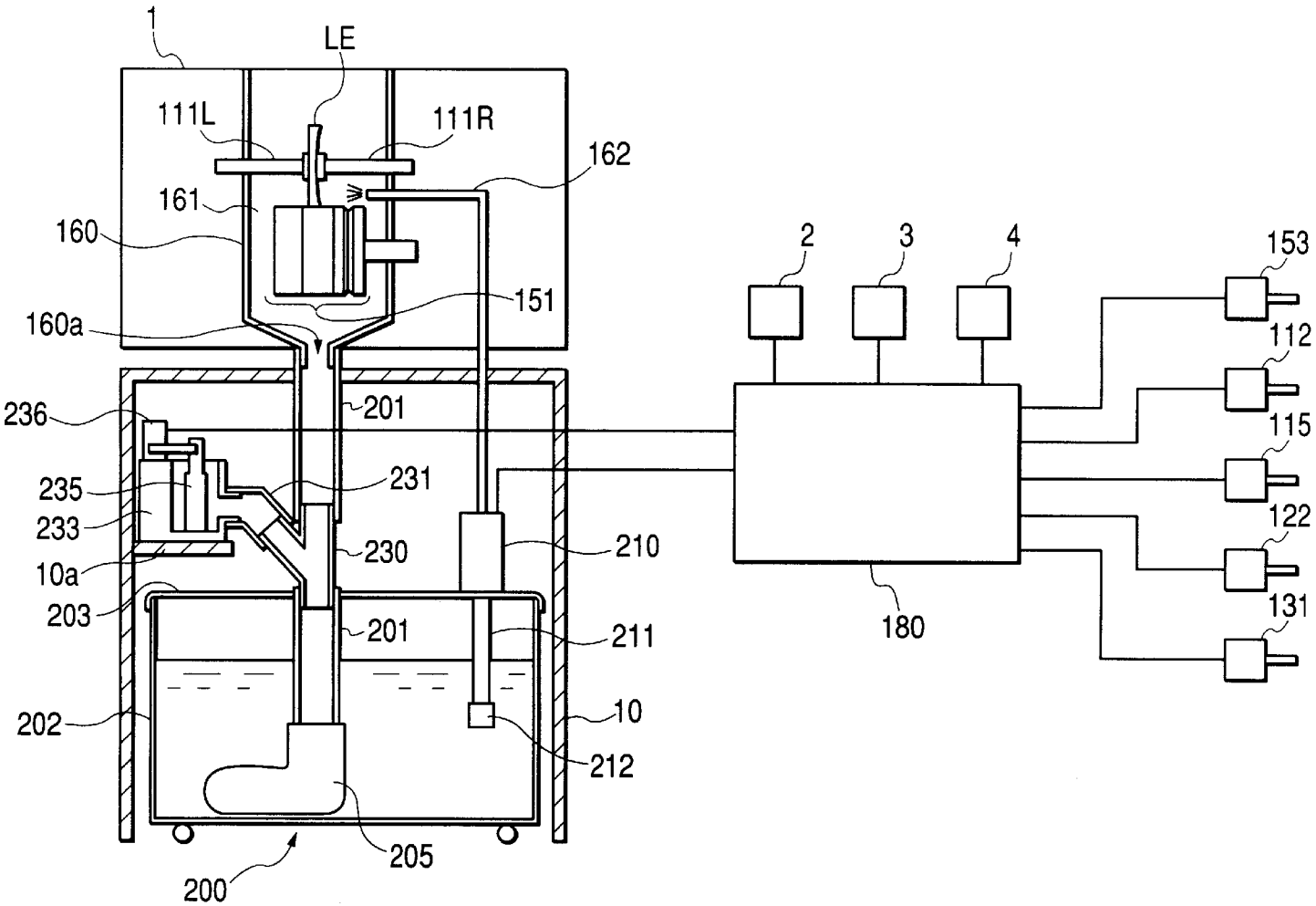
FIG. 4 is a view showing a schematic structure according to a variant.

FIG. 4 is a view showing a schematic structure according to a variant of the invention. The same elements as those in FIG. 3 have the same reference numerals and description thereof will be omitted.

In the example shown in FIG. 4, means for detecting that the drainage is clogged is provided in the middle of the drainpipe 201. A pipe (a hose) 231 is connected to branch through a connecting member 230 in the middle of the drainpipe 201. The pipe 231 is attached slightly upward from a connecting portion. The tip of the pipe 231 is connected to a small tank 233 and the small tank 233 is put on a middle plate 10*a* in the table 10. A float 235 floating on the water is provided in the small tank 233 and a switch 236 for detecting the floating state of the float 235 is provided on the small tank 233.

When the water is not discharged from the tip of the drainpipe 201 due to the clogging of the filter 205, the water level is raised so that the water flows into the small tank 233 side through the branching pipe 231. When the water flows into the small tank 233 so that the level thereof is raised, the float 235 floats and the floating is detected by a switch 236. An output signal of the switch 236 is input to the control section 180 and the control section 180 stops the water supply through the pump 210 and separates the lens LE from the grindstone 151, thereby temporarily interrupting the processing in the same manner as in the above example. Moreover, the display 3 is caused to display the message described above.

In some cases, a drainage cover having a large number of small holes is provided in the drainage port 160*a* in order to prevent the lens LE failing to be removed from flowing downward into the tank 202. In these cases, the drainage cover provided in the drainage port 160*a* is apt to be clogged with the processing wastes. Therefore, it is preferable that the means for detecting that the drainage is clogged should be provided on the processing chamber 161 side as in the above example. Also in such a structure that the float 235 and the switch 236 shown in FIG. 4 are used, it is a matter of course that they can be provided on the processing chamber 161 side.

While the circulating method using the pump 210 and the tank 202 has been taken as an example of the water supply method in the embodiment described above, the invention can also be applied to the case of a water supply direct connecting method.

Moreover, while the lens processing is carried out by means of the grindstone in the embodiment, another processing tool (an end mill) may be used. Furthermore, it is also possible to give, in a voice, a notice that the processing wastes are to be cleaned.

As described above, according to the invention, it is possible to prevent a water overflow from being caused by the clogging of the drainage. Moreover, the apparatus gives a notice that the drainage is clogged. Therefore, routine cleaning can be managed easily.

What is claimed is:

1. An eyeglass lens processing apparatus for processing a periphery of an eyeglass lens, comprising:

a processing chamber in which a lens processing tool is disposed;

water supply means for supplying water for lens processing to an interior of the processing chamber;

water drainage means for discharging the water from the processing chamber;

detect means for detecting a clogging state of the water drainage means; and water supply control means for controlling supply of the water by the water supply means based on a result of detection by the detect means.

2. The apparatus according to claim 1, further comprising:

notifying means for notifying the result of detection by the detect means.

3. The apparatus according to claim 1, wherein the detect means detects an amount of the water within the processing chamber.

4. The apparatus according to claim 1, wherein:

the water drainage means includes a drainage port provided to the processing chamber and a drainpipe connected to the drainage port; and the detect means detects an amount of the water within the drainpipe.

5. The apparatus according to claim 1, further comprising:

process control means for controlling the lens processing by the lens processing tool based on the result of detection by the detect means.

6. An eyeglass lens processing apparatus for processing a periphery of an eyeglass lens, comprising:

a processing chamber in which a lens processing tool is disposed, the processing chamber having a drainage port;

a water supply unit which supplies water for lens processing to an interior of the processing chamber;

a drainpipe connected to the drainage port;

a sensor which detects an amount of the water within the processing chamber or the drainpipe; and a controller which controls the water supply unit based on a result of detection by the sensor.

7. The apparatus according to claim 6, further comprising:

a notify unit which notifies the result of detection by the sensor.

8. The apparatus according to claim 6, wherein the controller controls the lens processing by the lens processing tool based on the result of detection by the sensor.

9. An eyeglass lens processing apparatus for processing a periphery of an eyeglass lens, comprising:

a processing chamber in which a lens processing tool is disposed;

water supply means for supplying water for lens processing to an interior of the processing chamber;

water drainage means for discharging the water from the processing chamber;

detect means for detecting a clogging state of the water drainage means; and notifying means for notifying the result of detection by the detection means.

* * * * *